United States Patent [19]

D'Amato

[11] Patent Number: 4,659,958

[45] Date of Patent: Apr. 21, 1987

[54] SUPPORT MEANS FOR USE WITH A LOW EXPANSION COLOR-SELECTION ELECTRODE

[75] Inventor: Ralph J. D'Amato, East Hempfield Township, Lancaster County, Pa.

[73] Assignee: RCA Corporation, Princeton, N.J.

[21] Appl. No.: 779,649

[22] Filed: Sep. 24, 1985

[51] Int. Cl.[4] ..... H01J 29/07

[52] U.S. Cl. ..... 313/405; 313/406; 313/407

[58] Field of Search ..... 313/405, 406, 407, 404

[56] References Cited

U.S. PATENT DOCUMENTS

| | | | |
|---|---|---|---|
| 3,368,098 | 2/1968 | Demmy . | |
| 3,387,159 | 6/1968 | Schwartz et al. . | |
| 3,700,949 | 10/1972 | Watanabe et al. | 313/405 |
| 3,803,436 | 4/1974 | Morrell . | |
| 3,808,493 | 4/1974 | Kawamura et al. . | |
| 3,898,508 | 8/1975 | Pappadis | 313/405 |
| 3,935,497 | 1/1976 | Cowles et al. | 313/405 |
| 4,572,983 | 2/1986 | Ragland, Jr. | 313/405 |

FOREIGN PATENT DOCUMENTS

| | | | |
|---|---|---|---|
| 0149639 | 8/1984 | Japan | 313/407 |
| 0207542 | 11/1984 | Japan | 313/407 |

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

An improved color picture tube according to the invention includes a faceplate panel having a cathodoluminescent screen thereon. A low expansion color-selection electrode is mounted in the faceplate panel by a support structure including a bimetal element. The support structure is responsive to changes in temperature of the faceplate panel and moves the color selection electrode relative to the screen.

13 Claims, 5 Drawing Figures

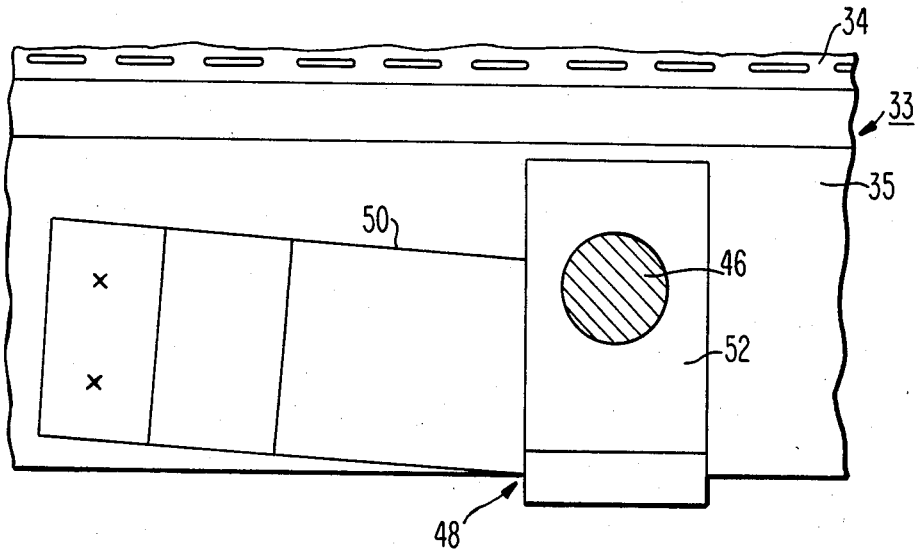
Fig. 3
Fig. 4
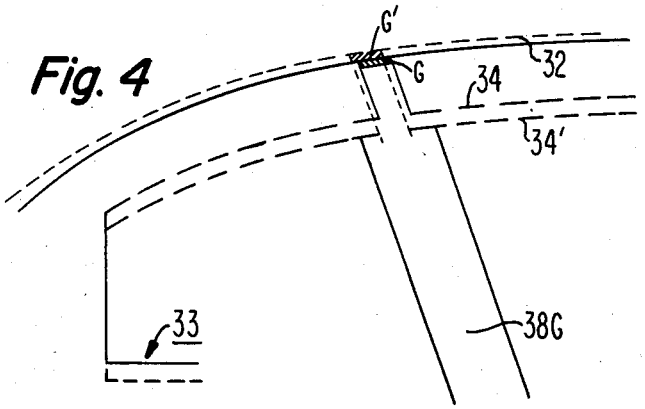

SUPPORT MEANS FOR USE WITH A LOW EXPANSION COLOR-SELECTION ELECTRODE

BACKGROUND OF THE INVENTION

This invention relates to a color picture tube of the type having a low expansion color-selection electrode or shadow mask attached to a frame which is suspended in spaced-relation to a cathodoluminescent screen comprising a mosaic of blue-emitting, green-emitting and red-emitting phosphor elements. More particularly, the invention relates to a support structure for such a tube which includes temperature compensation means which compensates for expansion of the tube envelope and faceplate panel caused by an increase in ambient temperature and the impingement of electron beams upon the color-selection electrode and screen.

U.S. Pat. No. 3,803,436 issued to Morrell on Apr. 9, 1974, discloses a plurality of shadow mask mounting assemblies. Each of the assemblies comprises a bimetal member attached to a shadow mask frame with a spring which interconnects the bimetal member to a stud embedded in the glass faceplate panel of the tube. The frame and shadow mask are conventional, i.e., they are preferably made of cold-rolled steel having a positive coefficient of thermal expansion, such that the frame and mask expand as their temperature increases. During the operation of the tube, the shadow mask intercepts about 80 percent or more of the electron beams directed from an electron gun toward the screen of the tube. The intercepted beams strike the mask and increase the temperature of the mask and frame causing them to expand. The outward expansion of the mask in relation to the screen would, without correction, cause misregister of the portions of the beams transmitted through the mask with the color elements of the screen. Correction or compensation is provided by the bimetal members attached to the frame, which react to the temperature increase of the frame and mask, and provide a compensating movement of the mask and frame toward the screen, thereby maintaining the desired mask-to-screen register.

U.S. Pat. No. 3,808,493 issued to Kawamura et al. on Apr. 30, 1974, discloses a shadow mask formed of Invar which has a coefficient of thermal expansion less than that of the cold-rolled steel mask described in the aforementioned Morrell patent. The Kawamura et al. patent discloses that the expansion of the Invar mask is negligible; however, the patent does not consider the heating effect on the glass envelope and faceplate panel of the ambient atmosphere and of the heat radiated from the shadow mask or from the impingement of electron beams on the faceplate panel of the tube.

The ambient temperature for color picture tube operation may be expected to vary from about 10° C. to about 45° C. for a temperature difference, Δ, of 35° C. Also, during tube operation, as the electron beams strike the shadow mask and faceplate panel raising the temperature of the shadow mask to about 35° C. above the ambient temperature, the faceplate panel temperature also will increase by about 7° C. In the worst case, the faceplate will experience a temperature change of about 42° C. (Δ(35° C.)+7° C.). The coefficient of thermal expansion of the glass used for the faceplate panel is about $99\times10^{-7}$/° C. so that for a 42° C. change in faceplate temperature, the glass will expand more than about 3 micrometers (μm) per centimeter. For a tube having a 25 inch diagonal faceplate, there would be about a 75 μm screen displacement at the ends of the major axis which would be sufficient to produce misregister of the transmitted beams with the phosphor elements. Comparable inward beam displacement results from the funnel expansion which displaces the yoke and increases the screen to yoke deflection center, producing an additional 75 μm misregister.

SUMMARY OF THE INVENTION

An improved color picture tube according to the invention includes a faceplate panel having a cathodoluminescent screen thereon and a low expansion color-selection electrode mounted in the faceplate panel by support means. The support means is responsive to changes in temperature of the faceplate panel and moves the color-selection electrode relative to the screen.

BRIEF DESCRIPTION OF THE DRAWINGS

FIG. 3 is a side view taken along line 3—3 of FIG. 2.

FIG. 4 is a schematic view of the color-selection electrode and screen during operation.

DETAILED DESCRIPTION OF THE PREFERRED EMBODIMENTS

Figure 1:
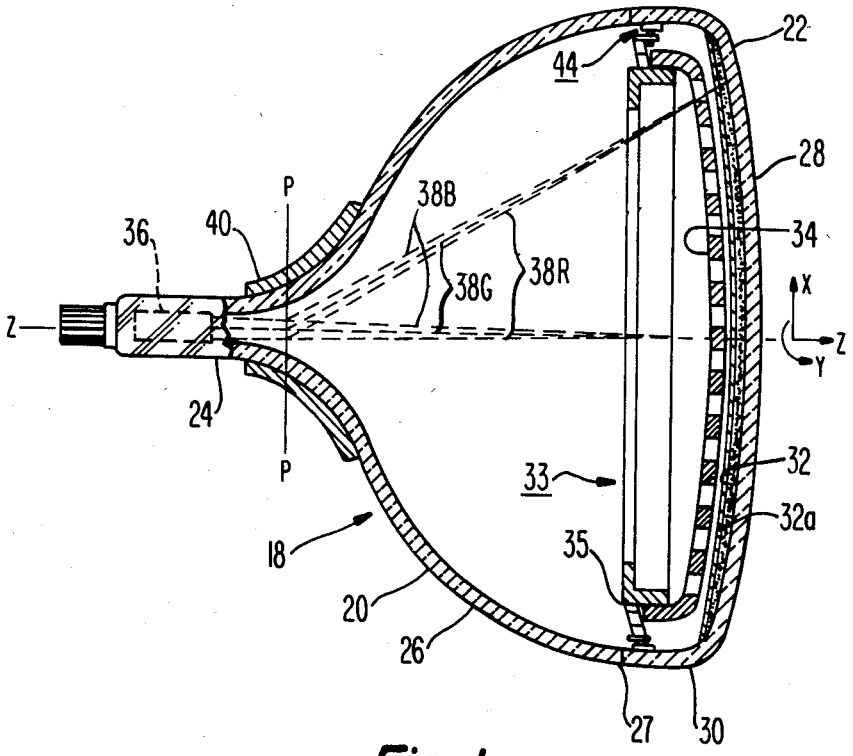
FIG. 1 is a plan view, partially in axial section, of a color picture tube having a color-selection electrode and incorporating the present invention.

FIG. 1 illustrates a substantially rectangular color picture tube 18 having an evacuated glass envelope 20 comprising a faceplate panel 22 and a tubular neck 24 joined by a funnel 26. The panel 22, having a major axis (X—X) and a minor axis (Y—Y), comprises a viewing faceplate 28 and a peripheral flange or sidewall 30, which is sealed to the funnel 26 by a frit material 27. A substantially rectangular three-color cathodoluminescent line screen 32 is located on the inner surface of the faceplate 28. The screen 32 comprises a mosaic of alternate lines of blue-, green- and red-emitting phosphor elements extending substantially parallel to the minor axis of the panel 22, so that the major and minor axes of the screen 32 are aligned with the major and minor axes of the panel. Portions of the screen 32 may be covered with a conductive, reflective material 32*a*, such as aluminum, in a manner known in the art. A color selection, or shadow mask assembly 33, comprises a multiapertured color-selection electrode, such as a shadow mask 34, and a frame 35. The shadow mask 34 is made of Invar (a Fe-Ni alloy containing about 36% Ni and 64% Fe) which has a small coefficient of thermal expansion, of the order of about $1.2\times10^{-6}$ per ° C. at 20° C. The shadow mask 34 is attached to the frame 35, which preferably also is made of Invar and has an L-shaped cross-section. The color selection assembly 33 is removably mounted within the panel 22 in predetermined spaced relationship to the screen 32. The shadow mask 34 includes a multiplicity of slit-shaped apertures, which are aligned in substantially parallel vertical columns, and web portions which separate the apertures in each column. If a dot screen is used, the apertures in the shadow mask 34 are circular.

An inline electron gun 36 (illustrated schematically) is mounted within the neck 24 to generate and direct three inline electron beams 38B, 38R and 38G along convergent paths through the shadow mask 34 to the screen 32. The longitudinal axis (Z—Z) of the tube 18 passes through the center of the electron gun 36 and through the center of the screen 32.

The tube 18 is designed to be used with an external magnetic deflection yoke 40 which surrounds the neck 24 and funnel 26 in the vicinity of their junction. When appropriate voltages are applied to the yoke 40, the three beams 38B, 38R and 38G are subjected to orthogonal magnetic fields that cause the beams to scan in the direction of the major screen axis, and in the direction of the minor screen axis, in a rectangular raster over the screen 32. The major and minor axes of the screen 32 are mutually perpendicular to one another and to the longitudinal axis (Z—Z) of the tube 18. For simplicity, the actual curvature of the paths of the deflected beams in the deflection zone is not shown in FIG. 1. Instead, the beams are schematically shown as having an instantaneous bend at the plane of deflection (P—P).

Figure 2:
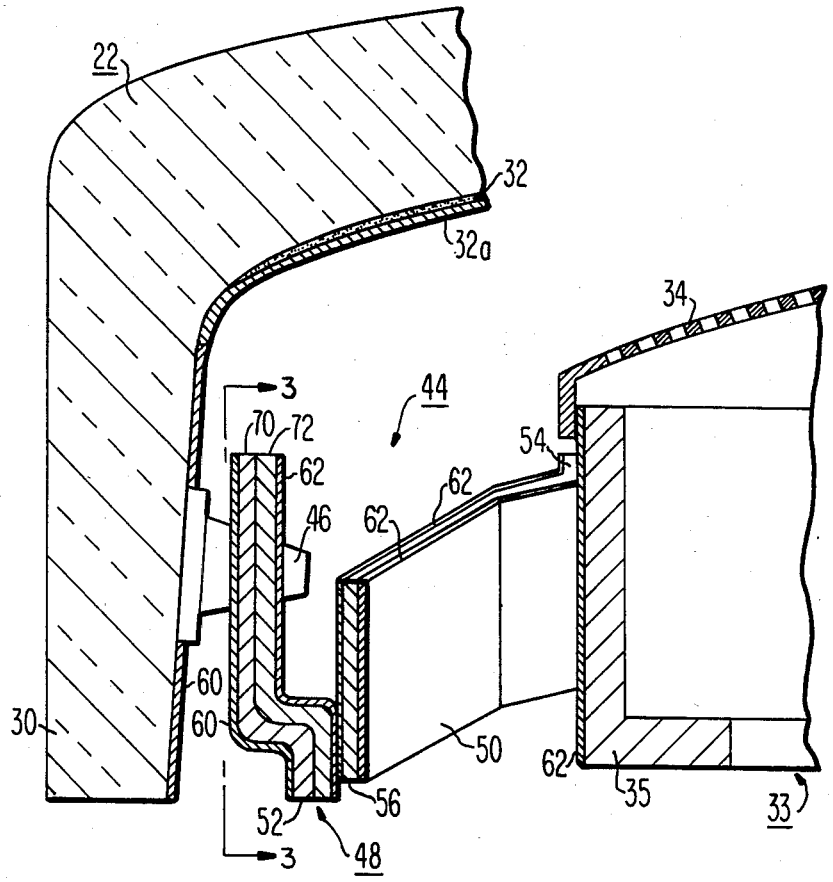
FIG. 2 is an enlarged view of a fragment of the color picture tube showing the support means for the color-selection electrode including the temperature compensation means.

A plurality of novel shadow mask support means 44 suspend the color selection assembly 33 within the panel 22. For large size tubes, typically four support eans 44 are used. As shown in FIG. 2, each support means 44 comprises a conventional metal stud 46 embedded into the sidewall 30 of the faceplate panel 22 and a novel spring assembly 48. The spring assembly 48 includes a spring 50 and a bimetal element 52 having a stud engaging aperture (not shown) therethrough. The spring 50 has a proximal end 54 attached to the outside surface of the frame 35 and a distal end 56 which is attached to the element 52. A side view of the spring assembly 48 is shown in FIG. 3. In a tube having a conventional high expansion shadow mask assembly formed from cold-rolled steel, having a coefficient of thermal expansion of about $13\times10^{-6}$ per ° C. at 20° C., it is usual to attach the bimetal portion of the spring assembly directly to the frame of the shadow mask assembly. The spring is attached between the bimetal portion and the stud embedded in the sidewall. This conventional arrangement locates the temperature responsive bimetal portion of the spring assembly adjacent to the higher temperature shadow mask assembly in order to sense the temperature increase in the shadow mask assembly due to the impingement thereon of the electron beams and to make the appropriate correction in the position of the shadow mask assembly. As disclosed in U.S. Pat. No. 3,803,436, referenced herein, as the shadow mask expands by reason of thermal effects, the shadow mask assembly must be moved axially toward the screen to maintain the desired alignment of the mask apertures and the phosphor elements on the screen. However, in tubes having a low expansion Invar color selection assembly 33, the shadow mask expansion is negligible at tube operating temperatures. Typically, the increase in shadow mask temperature due to electron beam bombardment is about 35° C. Thermal radiation effects and the impingement of the transmitted portions of the electron beams on the screen 32 cause about a 7° C. increase in faceplate panel temperature over the ambient temperature which can vary from about 10° C. to about 45° C. Since the expansion of the faceplate glass is greater than that of the Invar color selection assembly 33, misregister of the electron beams with the phosphor elements of the screen occurs, especially at the sides of the screen. The novel spring assembly 48 provides some correction by the location and shape of the bimetal element 52, as described hereinafter; however, a novel temperature compensation means enhances the action of the spring assembly 48. The temperature compensation means comprises a first emissivity modifying means 60 disposed on the inside surface of the sidewall 30 adjacent to the studs 46 and on the major surface of each of the bimetal elements 52 facing the sidewall. A second emissivity modifying means 62 is disposed on at least a portion of the frame 35 adjacent to the spring 50, on both major surfaces of the leaf spring 50, and on the other major surface of the bimetal element 52 attached to the leaf spring 50.

The first emissivity modifying means 60 comprises a dark conductive coating, such as dark aluminum, carbon, chromic oxide, iron oxide or other suitable material, although carbon is preferred. The dark coating enhances the thermal radiation transfer from the faceplate panel 22 to the bimetal element 52. The second emissivity modifying means 62 comprises a bright conductive coating, preferably aluminum, although gold or other suitable material, which will retard the radiation transfer from the shadow mask assembly 33 to the bimetal element 52 may be used.

As shown schematically in exaggerated detail in FIG. 4, during operation of the tube, the faceplate panel expands, causing the phosphor elements, represented by one element, G, to be displaced to position G′ on screen 32. The low expansion Invar shadow mask 34 is shown to intercept a portion of incident beam 38G and transmit a portion which falls on element G. As element G is translated to G′, misregister would occur unless the shadow mask were axially moved away from the screen 32 to a position 34′. In order to move the color selection assembly 33 away from the screen, the bimetal element 52 of FIGS. 2 and 3 must be configured to distort in that direction. With reference again to FIG. 2, the bimetal element 52 comprises a first metal layer 70 and a second metal layer 72. The first metal layer 70 has a lower coefficient of thermal expansion than the second layer 72. The first emissivity modifying means 60, comprising a carbon coating, is applied to the first metal layer 70 and the second emissivity modifying means 62, comprising a layer of bright aluminum, is applied to the second metal layer 72. As the tube reaches operating temperature, or as the ambient temperature increases, the carbon coating 60 on the sidewall 30 radiates heat, which is absorbed by the carbon coating 60, on the first conductive layer 70 of the bimetal element 52. The reflective aluminum coating 62 on the second conductive layer 72 of the bimetal element 52 reflects some of the heat from the color selection assembly 33 so that the bimetal element 52 primarily senses the temperature increase of the faceplate panel. As the element 52 increases in temperature, the high thermal expansion layer 72 expands more than the layer 70 so that the element 52 bends in the direction of the low expansion layer 70. The step-like portion of element 52 contributes a downward component of motion which lowers the color selection assembly 33 relative to the faceplate panel 22 to maintain register between the portion of the beam passing through the shadow mask aperture and the phosphor elements on the screen 32.

Figure 5:
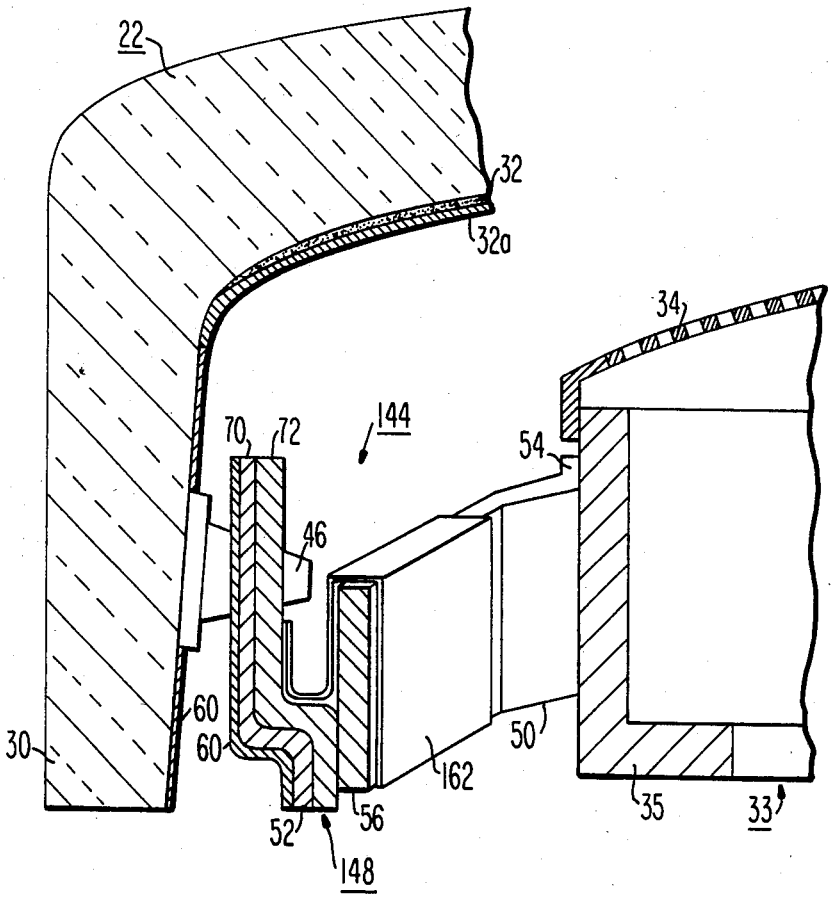
FIG. 5 is an enlarged view of a fragment of the color picture tube showing a second embodiment of the support means for the color-selection electrode including the temperature compensation means.

An alternative embodiment of the present invention is shown in FIG. 5, wherein like numbers designate elements that are identical to those described previously.

In this embodiment, a novel shadow mask support means 144 comprises a conventional metal stud 46 embedded into the sidewall 30 of the faceplate panel 22 and a novel spring assembly 148. The spring assembly 148 includes a spring 50 and a bimetal element 52 having a stud engaging aperture (not shown) therethrough. The spring 50 has a proximal end 54 attached to the outside surface of the frame 35 and a distal end 56 which is attached to the element 52. A novel temperature compensation means enhances the action of the spring assembly 148. A first emissivity modifying means 60 is disposed on the inside surface of the sidewall 30 adjacent to the studs 46 and on the major surface of each of the bimetal elements 52 facing the sidewall. A second emissivity modifying means 162 is disposed on at least a portion of the spring 50. Preferably, the second emissivity modifying means is on both major surfaces of the spring 50 and on at least a portion of the other major surface of the bimetal element 52 attached to the spring 50. The second emissivity modifying means 162 may, for example, comprise a sheet of reflective metal foil, such as aluminum or gold foil, wrapped around the spring 50 and extending along a portion of the other major surface of the bimetal element 52. This embodiment is simpler than the previously described embodiment and therefore less expensive to implement, requiring only the deposition of first emissivity modifying means 60 on the faceplate panel adjacent to the studs 46 and on the facing surface of the bimetal elements 52.

What is claimed is:

1. In a color picture tube including a faceplate panel having a cathodoluminescent screen thereon and a color selection electrode mounted in said faceplate panel by support means, the improvement comprising said support means including a bimetal element having at least one emissivity modifying means disposed on a portion thereof facing said faceplate panel, thereby rendering said support means responsive to changes in temperature of said faceplate panel for moving said color selection electrode relative to said screen.

2. In a color picture tube including a faceplate panel having a cathodoluminescent screen thereon and a low expansion shadow mask assembly mounted in said faceplate panel by support means, the improvement comprising said support means including a bimetal element including means on a side thereof facing said panel that enhances the thermal radiation transfer from said panel to said bimetal element.

3. The tube as described in claim 2, wherein said support means further includes a plurality of studs attached to said panel, said bimetal elements interconnecting said studs and said shadow mask assembly.

4. The tube as described in claim 3, wherein said means for enhancing the thermal radiation transfer is also provided on said faceplate panel adjacent said studs.

5. The tube as described in claim 3, wherein a spring is attached at one end to each of said bimetal elements and each of said springs is attached at the other end to said shadow mask assembly.

6. In a color picture tube of the type including an evacuated envelope having a faceplate panel with a cathodoluminescent screen thereon, a low expansion color-selection electrode having a plurality of apertures therein, said color-selection electrode being suspended in said faceplate panel by support means, and electron-generating means for producing a plurality of electron beams, said support means comprising a plurality of studs attached to said faceplate panel and a plurality of spring assemblies connecting said color selection electrode to said studs, wherein the improvement comprises each of said spring assemblies includes a spring attached to said color selection electrode and a bimetal element with a stud engaging aperture therethrough, said bimetal element interconnecting said spring and one of said studs, and temperature compensation means including a first emissivity modifying means provided on the surface of each of said bimetal elements adjacent to said studs to enhance the radiation transfer from said faceplate panel, and a second emissivity modifying means provided on the major surfaces of each of the springs and on the surface of said bimetal elements attached to said spring to retard radiation transfer from said color-selection electrode to said bimetal elements, said temperature compensation means acting in combination with said spring assemblies to move said color-selection electrode away from said faceplate panel in order to maintain said color-selection electrode in register with said screen when said envelope and faceplate panel expand as a result of the temperature increase caused by an increase in the ambient temperature and by the impingement of said electron beams on said faceplate panel.

7. The tube as described in claim 6, wherein said temperature compensation means further includes said first emissivity modifying means being provided on the inner surface of said faceplate panel adjacent to said studs.

8. The tube as described in claim 6, wherein said temperature compensation means further includes said second emissivity modifying means being provided on said color-selection electrode adjacent to said spring.

9. The tube as described in claim 7, wherein said first emissivity modifying means comprises a dark conductive coating selected from the group consisting of dark aluminum, carbon, iron oxide and chromic oxide.

10. The tube as described in claim 8, wherein said second emissivity modifying means comprises a bright conductive coating selected from the group consisting of aluminum and gold.

11. In a color picture tube of the type including an evacuated envelope having a faceplate panel with a sidewall and a substantially rectangular faceplate portion, said faceplate panel having an inside surface, a cathodoluminescent screen comprising a mosaic of blue-emitting, green-emitting and red-emitting phosphor elements disposed on said inside surface of said faceplate panel, an electron gun within said envelope for generating and directing a plurality of electron beams toward said screen, and a low expansion assembly comprising a frame and a shadow mask disposed between said electron gun and said screen for intercepting portions of said electron beams, said shadow mask having a plurality of apertures therein for passing other portions of said electron beams therethrough, said shadow mask and said faceplate panel being heated by said electron beams, said apertures in said shadow mask being maintained in register with said phosphor elements of said screen by support means comprising a plurality of studs attached to said inside surface of said sidewall of said faceplate panel and a plurality of spring assemblies connecting said shadow mask assembly to said studs, wherein the improvement comprises each of said spring assemblies includes a spring having a distal end and a proximal end, and a bimetal element having two layers of dissimilar metal, said bimetal element having a stud engaging aperture therethrough, said proximal end of said spring being attached to said frame of said shadow mask assembly and said distal end of said spring being attached to said bimetal element, and temperature compensation means including a first emissivity modifying means being disposed on said inside surface of said sidewall of said faceplate panel adjacent to said studs and on one major surface of each of said bimetal elements, said one surface being adjacent said sidewall of said faceplate panel, said first emissivity modifying means being provided to enhance the radiation transfer from said faceplate panel to said bimetal element, and a second emissivity modifying means disposed on at least a portion of said frame of said color selection assembly, on bOth major surfaces of each of said leaf springs, and on the other major surface of said bimetal element that is attached to said spring, said second emissivity modifying means being provided to retard radiation transfer from said shadow mask assembly to said bimetal element, said temperature compensation means including said first and said second emissivity modifying means acting in combination with said bimetal element and said spring to move said color selection assembly away from said faceplate panel to compensate for the expansion of said faceplate caused by said electron beams and by increases in the ambient temperature, thereby maintaining said apertures in said shadow mask in register with said phosphor elements of said screen.

12. The tube as described in claim 11, wherein said first emissivity modifying means comprises a dark conductive coating selected from the group consisting of dark aluminum, carbon, iron oxide and chromic oxide.

13. The tube as described in claim 11, wherein said second emissivity modifying means comprises a bright conductive coating selected from the group consisting of aluminum and gold.

* * * * *